United States Patent [19]

Blackwell et al.

[11] Patent Number: 4,811,799

[45] Date of Patent: Mar. 14, 1989

[54] BANJO BOX AND BLOOIE LINE SPOOL

[75] Inventors: Wayne V. Blackwell, Kelseyville; William P. Warren, Santa Rosa, both of Calif.

[73] Assignee: Union Oil Company of California, Los Angeles, Calif.

[21] Appl. No.: 19,585

[22] Filed: Feb. 27, 1987

[51] Int. Cl.[4] ..... E21B 21/00

[52] U.S. Cl. ..... 175/209; 166/76; 166/88; 175/211; 285/17

[58] Field of Search ..... 285/15-17, 285/179; 406/193, 195; 175/206, 207, 209-211, 213, 71; 166/91, 76, 88, 85, 75.1, 902

[56] References Cited

U.S. PATENT DOCUMENTS

| | | | |
|---|---|---|---|
| 1,243,874 | 10/1917 | Poppenhusen et al. | 285/17 |
| 1,510,928 | 10/1924 | Ellman | 285/17 X |
| 1,601,093 | 9/1926 | Widmeyer | 285/16 |
| 1,668,855 | 5/1928 | Ludlum | 406/193 X |
| 4,161,222 | 7/1929 | Pye | 175/66 |
| 4,304,310 | 12/1981 | Garrett | 285/16 X |
| 4,355,997 | 10/1982 | Smith et al. | 23/230 EP |
| 4,363,357 | 12/1982 | Hunter | 175/209 X |
| 4,402,910 | 9/1985 | Smith et al. | 422/83 |

OTHER PUBLICATIONS

Advertisement of Stoody Company of "Vancar®", 1/1984, 4 pages.

Chart prepared by Stoody Company for "Non-Ferrous Hard-Facing Materials", 1 sheet.

Advertisement of Stoody Company entitled "Stoody Alloys for Open Arc, Semi-Automatic Application", 2 pages.

Advertisement of Packo Industrial Ceramics, Inc. for "Standard Wear Alumina Tile Lining", 2 pages.

Advertisement of Coors Ceramics for "Cerasurf", 1 page.

*Primary Examiner*—Hoang C. Dang

*Attorney, Agent, or Firm*—Gregory F. Wirzbicki; June M. Bostich; Howard R. Lambert

[57] ABSTRACT

A fluidtight housing such as a banjo box receives and redirects the debris-laden upward flow of fluids from a reservoir. The housing connecting the wellhead of the reservoir with a flowline positioned at an angle other than the vertical receives fluid and debris from the wellhead and redirects them into the flowline. A replaceable and repositionable insert having at least one high wear zone is mounted within the housing so that the flow of fluid and debris impinges against a wear zone on the interior of the insert. Fresh wear zones can be exposed at the point of impact of the fluid stream without the need to remove the housing or insert from its position between the wellhead and the flowline, preferably by rotating the insert within the housing.

14 Claims, 3 Drawing Sheets

BANJO BOX AND BLOOIE LINE SPOOL

BACKGROUND OF THE INVENTION

This invention relates to geothermal wellhead apparatus and in particular to apparatus for controlling the flow of fluids and debris from a geothermal well.

The flow control of fluids from a well during drilling operations or production is complicated by the debris produced with the fluids. Debris, such as formation solids, pieces of well casing or well hardware, and even scale or corrosion products, impact with sufficient force against the interior of the wellhead apparatus and downstream equipment to cause excessive wear. Solids produced at a high velocity tend to erode valve seats, pipe walls, and other materials they contact. In addition, solids of appreciable size can become lodged in orifices or valve seats and thereby restrict fluid flow. In some cases a throttling valve, orifice or choke bean can be rendered totally useless due to a combination of wear and plugging. Debris can also accumulate in many low points in the flowline, causing flow restrictions and influencing corrosion and erosion rates.

Flow of fluids from geothermal steam wells is particularly subject to the problem of entrained debris moving at high velocity. The high velocity of geothermal flow, which ranges up to a million pounds per hour of produced fluids from a single well, entrains more and larger solids in geothermal fluids than are found in flow from other wells. For instance, as much as 100 pounds per month of debris can issue from a typical steam-producing well.

The problems associated with entrained debris from geothermal steam wells are particularly acute during air-drilling operations when compressed air is used to circulate rock cuttings out of the wellbore. As zones are penetrated that contain compressed geothermal fluids, large volumes of steam are suddenly released which accelerate the rock cuttings to very high velocities. Due to the high velocity of the fluids, large pieces of abrasive rock are readily entrained and carried out of the reservoir. The problem is complicated by the necessity to deflect the upward vertical flow out of the wellbore towards the horizontal at the surface to send it to a rock separator and muffler. The interior surface of the equipment used to turn the fluid flow, commonly called the banjo box, can be worn completely through during drilling of a single geothermal well, with the result that drilling crews are exposed to injury from scalding steam and sharp-edged rock cuttings travelling at high velocity. In addition, replacing the defective banjo box requires costly shutdown of the entire drilling operation while the surface equipment is disassembled to install a new banjo box.

Accordingly, the need exists for a banjo box apparatus particularly adapted to redirecting the high-velocity vertical flow of debris-laden fluids out of a geothermal wellbore, especially those encountered during air drilling of geothermal reservoirs, and having a high wear interior surface capable of withstanding impact of fluids and debris throughout an entire drilling operation.

SUMMARY OF THE INVENTION

A fluidtight housing is provided for receiving the upward flow of a debris-laden fluid stream and redirecting the fluid stream in a direction at an angle less than 180 degrees from the upward flow, the housing having a repositionable insert extending therewithin to provide a sacrificial wear surface against which the upwardly moving fluid stream impinges and is redirected.

BRIEF DESCRIPTION OF THE DRAWING

The present invention will be more readily understood by reference to the figures of the drawing.

DETAILED DESCRIPTION OF THE INVENTION

Provided herein is an apparatus useful for directing flow of fluids from wells producing debris-laden fluids. More particularly, the apparatus provided herein is useful for redirecting the flow of debris-laden fluids produced at high velocity such as are encountered in the air drilling of geothermal steam wells. In the present invention an improved banjo box is provided to overcome the problems associated with high wear caused by debris-laden fluids. The banjo box comprises (1) a housing connected to a vertical wellhead for receiving fluids and debris flowing from a well and discharging them into a conduit having an axis other than vertical, and (2) a replaceable and repositionable insert having a first sacrificial high wear surface, at least a portion of said insert being slideably mounted within the housing so that the wear surface can be positioned to expose a multiplicity of different wear zones at the point of critical wear to receive the impact of vertically flowing fluids and debris from the well against the sacrificial high wear surface, thereby redirecting the fluids and debris into the flowline. The banjo box and insert combination optionally includes a means for repositioning the insert without removal of the insert from the housing or removal of the housing and insert from the wellhead to replace a worn zone by a fresh wear zone on the interior of the insert at the point of critical wear.

In the preferred embodiment, the apparatus comprises a cylindrically shaped conduit section having an opening into a cylindrical tee extension for redirecting a vertically flowing stream of fluids and debris into a horizontal blooie line. The tee extension acts as a sleeve to receive a cylindrical, rotatable insert spool with a sacrificial wear surface lining the interior of the cylinder. The insert spool is slideably, detachably, and rotatably mounted within the sleeve of the banjo box by means of mated flanges so that the stream of debris laden fluid impacts against the sacrificial wear surface lining the insert spool at a wear zone on the surface and is redirected into a blooie line attached to the distal end of the insert spool by means of a second pair of mated flanges. When both sets of flanges are loosened or unfastened, the insert spool can be rotated within the sleeve to expose a fresh wear zone on its high-wear interior surface at the point of critical wear.

Figure 1:
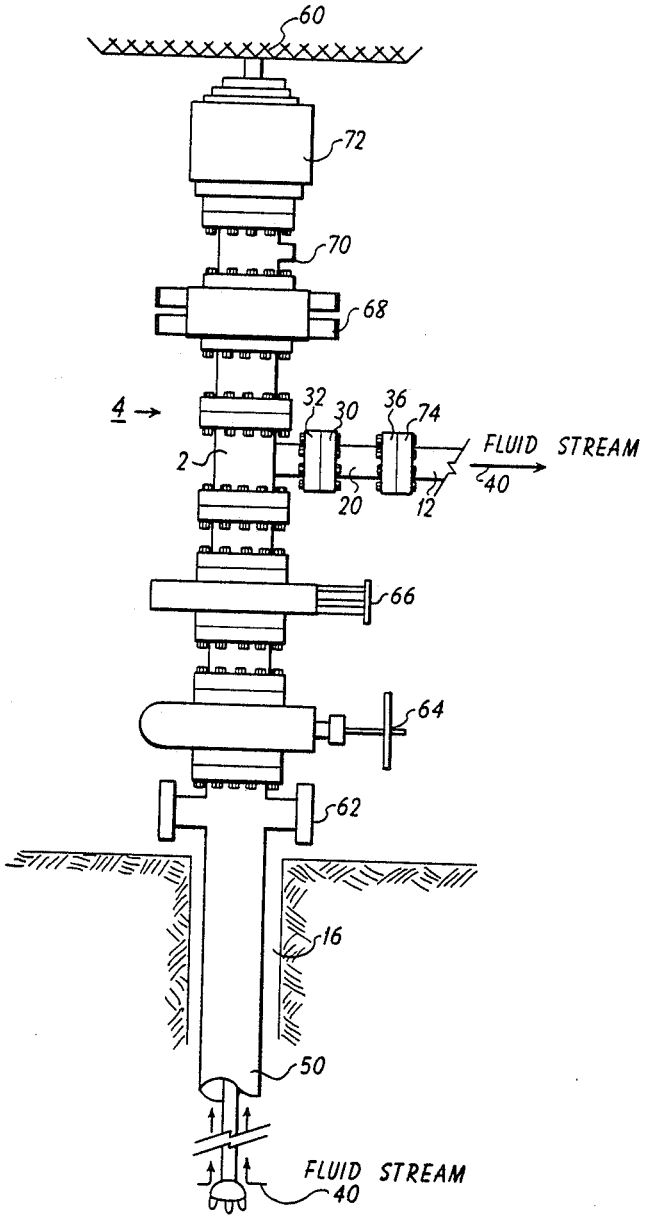
FIG. 1 shows the fluidtight housing and insert spool in position in the wellhead apparatus of a reservoir.

The preferred embodiment is shown more particularly in reference to the figures of the drawing. FIG. 1 shows wellhead apparatus 4 extending vertically between wellstem 50 and the rig floor 60 and comprising casing head 62 and banjo box 2 attached to insert spool 20 and blooie line 12. Wellhead apparatus 4 also optionally comprises double rotating head 72, mud cross 70, double gate blow out preventer 68, hydraulic slab gate valve 66, and master valve 64. Produced fluids and debris travelling vertically through wellhead apparatus 4 out of wellbore 16 at high pressure and high velocity enter banjo box 2 and are diverted into insert spool 20 from which they exit via blooie line 12.

Figure 2:
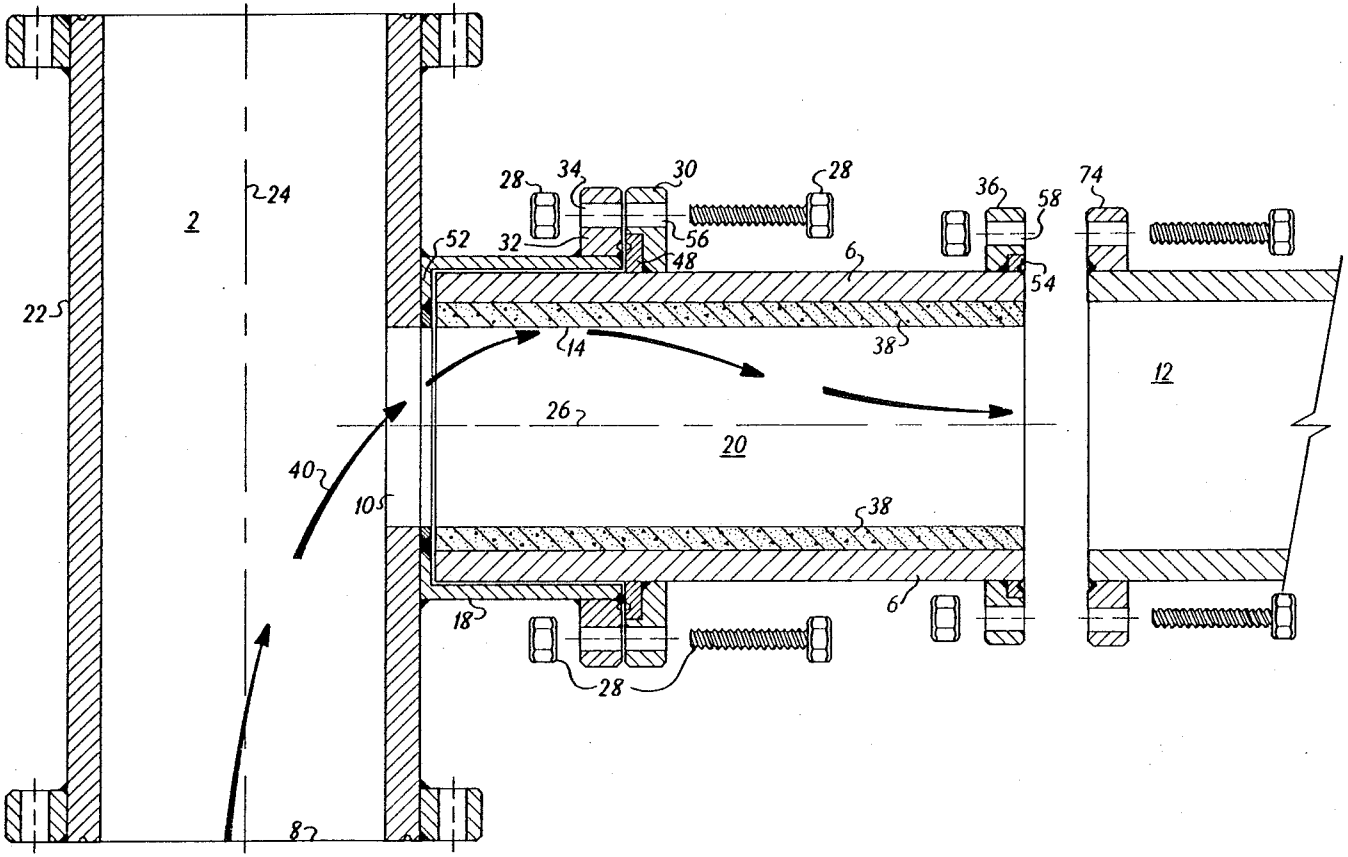
FIG. 2 shows a detailed view of the housing and insert spool.
Figure 3:
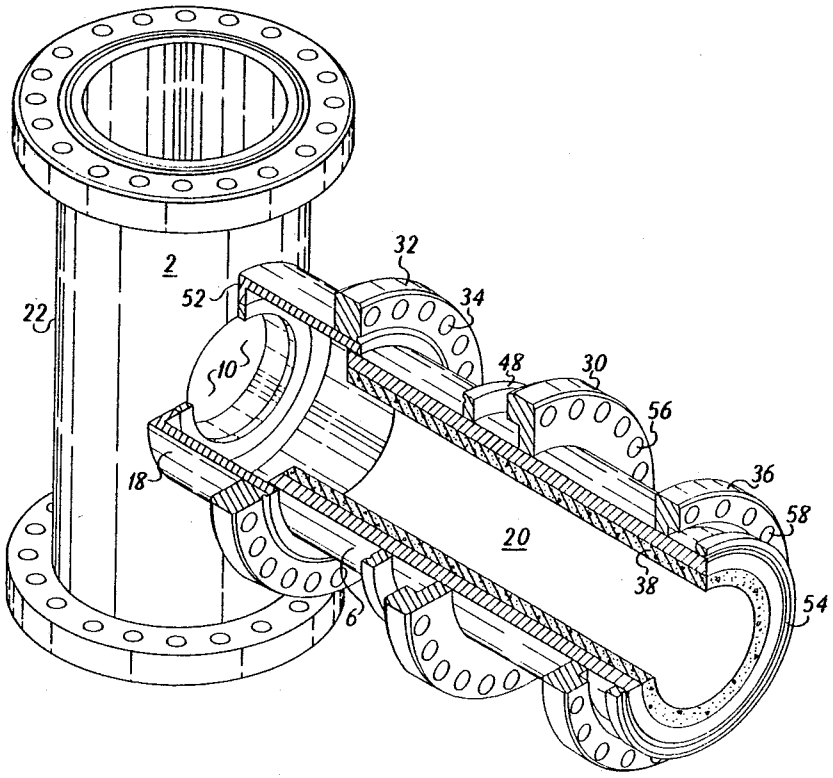
FIG. 3 shows a cut-away view of the housing and insert spool with sacrificial lining material.

As shown in FIGS. 2 and 3, the flow of fluids is redirected at a 90 degree angle from the vertical by the impact of debris-laden fluid stream 40 at point of critical wear 14 upon coating or lining material 38 covering the interior surface of insert spool 20, but in use the angle of redirection can be any angle less than 180 degrees, for instance at 135 degrees, or less, but preferably about 90 degrees. The change in direction of debris-laden fluid stream 40 upon impact with the interior of insert spool 20 results from there being a large pressure differential between the wellhead and the point of exit into blooie line 12, which is generally maintained at atmospheric pressure. Fluids passed out of the wellhead and redirected via the banjo box through the blooie line are generally sent to a rock separator and/or muffler (not shown) attached to the exit from blooie line 12.

As shown in FIGS. 2 and 3, banjo box 2 is comprised of a first cylindrical section 22 having axis 24, entrance opening 8, and circular exit opening 10 in the wall of first cylindrical section 22. A second cylindrical section 18 forms a sleeve fluidtightly attached to first cylindrical section 22 by means of ring 52 attached thereto by a weld and extending therefrom at a 90 degree angle so that axis 26 of second cylindrical section 18 forms a 90 degree angle with axis 24 of first cylindrical section 22. The proximal end of second cylindrical section 18 attaches to first cylindrical section 22 by means of ring 52 so as to encircle exit opening 10 in the wall of first cylindrical section 22, the center of circular exit opening 10 lying upon axis 26 of second cylindrical section 18.

Flange 32 forms a stationary extension at a 90 degree angle from the distal end of cylindrical section 18. A multiplicity of means 34 for receiving attaching means 28 are spaced at equidistant intervals around a circle lying on the surface of flange 32. Usually flange 32 is pierced by between three and about twelve boreholes 34 capable of receiving fastening means 28, preferably a bolt and nut, for holding flange 32 abutted in a fluidtight seal against a second mated flange 30. However, fastening means 28 can be any suitable means for detachably fastening flanges together. Flange 30 is slideably mounted so as to encircle third cylindrical section 6 and abut against ring stop 48 when slid into position and attached to flange 32. Flange 30 is provided with a multiplicity of means 56 for receiving attaching means 28 spaced at equidistant intervals around a circle on the surface of flange 30, usually a number equal to those provided in flange 32, so that flanges 30 and 32 can be fastened together to form a fluidtight seal.

Blooie line insert spool 20 comprises a third cylindrical section 6 having a diameter sufficiently smaller than the diameter of second cylindrical section 18 to fit slideably, rotatably, and fluid-tightly within the sleeve formed by second cylindrical section 18 of banjo box 2 so that a friction seal is provided between cylindrical section 18 and third cylindrical section 6 and so that the axis of third cylindrical section 6 lies along axis 26 of second cylindrical section 18. Usually, when the insert spool is in place within the sleeve of the banjo box as shown in FIG. 2, the end of third cylindrical section 6 abuts against ring 52, which attaches at a 90 degree angle to the proximal end of second cylinder 18 of first cylindrical section 22. Slide stop 48 is affixed in a stationary jointure to the exterior of cylindrical section 6, extending at a 90 degree angle from the exterior of third cylindrical section 6 so that ring stop 48 abuts against the distal end of second cylindrical section 18 when the proximal end of third cylindrical section 14 abuts against ring 52. Wear resistant coating or lining material 38 covers the interior surface of third cylindrical section 6.

Flange 36 is slideably mounted so as to encircle third cylindrical section 6. Stationary ring stop 54 is attached to the exterior of third cylindrical section 6 at its distal end. When flange 36 is positioned against a mating flange 74 on blooie line 12, flanges 36 and 74 abut on either side of ring stop 54.

Blooie line 12 attaches to the distal end of insert spool 20 by abutting flange 36 on insert spool 20 and flange 74 on blooie line 12 against ring stop 54 on third cylindrical section 6 and inserting the fastening means through means for receiving fastening means so as to form a fluidtight seal. Flanges 36 and 74 are usually provided with a multiplicity of equidistant fastening means equal to those used to fasten together flanges 32 and 30.

One of the critical features of this invention is found in the rotatability of cylinder 6 within sleeve 18 without need to remove banjo box 2 and blooie line spool 20 from its position within wellhead equipment 4. As a result of this feature, when the wear surface at point of critical wear 14 becomes worn, fresh wear zones on coating or lining material 38 can be easily rotated to point of critical wear 14 to receive impact of the fluids and entrained particles flowing through banjo box 2 into blooie line 12. To accomplish this, the fastening means are detached so as to loosen flanges 30 and 36. Once the flanges are loosened, insert spool 20 is freely rotatable within the tee extension of banjo box 2 to expose successive fresh wear zones on the surface of lining material 38. A multiplicity of fresh wear zones can be exposed at the point of critical wear by rotating the insert spool a partial revolution. Once a fresh wear zone has been rotated to point of critical wear 14, the fastening means can be replaced so as to form fluidtight seals between the banjo box, the insert spool, and the blooie line.

It should be noted that the location of point of critical wear 14 along the length of insert spool 20 depends upon the velocity of the stream of fluids and debris 40 exiting the wellbore, a high velocity fluid stream causing the point of critical wear to be located closer to the distal end of insert spool 20 than for a fluid stream of lesser velocity. Therefore, the length of sleeve 18 and of insert spool 20 should be selected so as to accommodate the velocity of the fluids issuing from the well on which the banjo box and blooie line spool are to be used.

It is a particular advantage of this invention that the banjo box and blooie line insert spool can be readily fabricated from sections of preformed metal conduit of the type usually used to manufacture wellhead equpment. Metal conduit having a wall thickness of between three-fourths and one and one-half inches can be used to form the cylindrical sections of the banjo box and blooie line spool. One method of extending the life of the insert spool is to fabricate third cylindrical section 6 from a section of conduit having a wall thickness of between about one and four inches. In this embodiment of the invention the lining or coating material is omitted, and the high wear zones are located on the interior of the metal conduit section forming third cylindrical section 6. In a variation of this embodiment, the section of cylindrical conduit used to form third cylindrical section 6 is thickened on the interior using a welding process to build up thickness of the conduit wall.

However, in the preferred embodiment, lining material 38 covers the interior of third cylindrical section 6 and is comprised of any high impact and/or high wear material that can be permanently applied to the interior surface of the blooie line insert spool. For instance, high alloy steels, such as Stoody or Vancar high alloy steels manufactured by Stoody Company, Industry, California, have been used to coat the interior of the insert spool by means of a weld-metal deposit technique. Alternatively, a high impact rubber cylinder, formed by successively wrapping thin sheets of ethyl-propylene elastomers (commonly referred to as EPDM rubbers) over a mold at vulcanization temperature, can be applied to the interior of the insert spool. EPDM rubbers having a hardness of about 60 to 80 durometer units as measured by a Durometer Hardness Tester such as is manufactured by Shore Instrument & Manufacturing Co., Inc. are preferred for use in this embodiment. The molded rubber inserts are glued or held in place within the insert spool with mechanical stops. In yet another embodiment, cement of th type used for cementing wellcasings into the wellbore of a petroleum or geothermal well can be cast into the insert spool by pouring the cement into an annulus formed by coaxially inserting into the insert spool a cylindrical form having a diameter about 2 to 5 inches smaller than the internal diameter of the insert spool. Polymer concrete of the type suitable for use in geothermal applications can be spin cast inside the insert spool and allowed to cure to form coating 38.

However, in the preferred embodiment, alumina or silicon ceramic materials are used to form lining 38 within the insert spool. Most preferred among the alumina ceramics are those having a purity of between 80 and 90 percent. Most preferred among the silicon ceramics are the nitrate-bonded, reaction-bonded, and recrystalized forms of silicon carbide. To form the lining for the insert spool, the alumina or silicon ceramics are fabricated into either tile or bricks which are permanently attached to the inside of the spool by means of temperature resistant adhesives, room temperature vulcanizing (RTV) rubber, or epoxy. Alternatively, the ceramic tile or bricks can be fastened into place using a welding process. In yet another embodiment, the ceramic materials can be fabricated into a monolithic cylinder and attached to the inside of the spool with adhesives or mechanically retained with stops welded into the insert spool.

Other materials among those suitable for coating the inside of the insert spool include room temperature vulcanizing (RTV) rubber; high temperature epoxy, such as Bakerlok manufactured by Baker International Corporation; Silicon Seal, manufactured by General Electric Company; ceramic, titanium, and carbide putties, such as those manufactured by Devcon Manufacturing Company; epoxies; urethanes; and other elastomer compounds.

The list of materials enumerated here as suitable for coating or lining the interior of the insert spool is by way of example only, and is not intended to be exclusive.

The invention is further described by the following examples which are illustrative of specific modes of practicing the invention and are not intended as limiting the scope of the invention as defined by the appended claims.

In testing the material used to coat the interior of the banjo box, a comparative wearability rating was developed by using the materials during actual air drilling of a geothermal well as follows. A sample lining material was put into service in the insert to the banjo box during actual air drilling of a geothermal well and was inspected frequently during initial bit trips until chances of catastrophic failure were determined to be low. Thereafter the insert spool was left in place within the banjo box and rotated to expose a fresh wear zone at the point of critical wear every two-bit runs, or every 40 to 45 drilling hours when drilling at a rate of 10 to 30 feet per hour. Upon completion of air-drilling, the banjo box and insert were removed and the coating or lining material covering the interior of the insert was inspected for wear. The overall performance of the lining material was then assigned a relative wearability rating taking into account the wearability, cost, ease of installation (including the bonding method), and ease of repair. The lining materials tested, their material contents and geometry within the insert spool, and relative wearability ratings are summarized in Table 1 and relative bonding wearability in Table 2.

TABLE 1

| EX. NO. | LINING MATERIAL | MANU-FACTURER | TRADE-NAME | MATERIAL CONTENT | MATERIAL GEOMETRY | RELA-TIVE WEAR-ABILITY |
|---|---|---|---|---|---|---|
| 1 | Vanadium Carbide | Stoody Co. P.O. Box 1901 Industry, CA 91749 | Vancar TM S.A. | Iron base w/41% alloying materials including vanadium, tungsten, chromium, carbon, boron, manganese and silicon | Weld bead - hardfacing material layed down in concentric rows on inside surface of plain carbon steel spool | 7 |
| 2 | Tungsten Carbide | Stoody Co. P.O. Box 1901 Industry, CA 91749 | Stoodex-6 | Cobalt base with alloying materials including chromium, tungsten, carbon, silicon, and manganese | Weld bead - hardfacing material layed down in concentric rows on inside surface of plain carbon steel spool | 7 |
| 3 | High Alloy Steel | Stoody Co. P.O. Box 1901 Industry, CA 91749 | Stoody 101 - HC | Iron base with 30% alloying materials including chromium, manganese, silicon and carbon | Weld bead - hardfacing material layed down in concentric rows on inside diameter of plain carbon steel spool | 7 |
| 4 | Alumina Oxide | Pakco Industrial Ceramics 55 Hillview Ave. Latrobe, PA 15650 | Durafrax TM | 87% pure alumina oxide | Formed into 9" L × 2" W bricks with beveled edges. | 10 |
| 5 | Elastomer | Grant Oil Tool Co. | unknown | EPDM - a proprietary | Formed into a 16 1/16" OD × | 2 |

TABLE 1-continued

| EX. NO. | LINING MATERIAL | MANU-FACTURER | TRADE-NAME | MATERIAL CONTENT | MATERIAL GEOMETRY | RELA-TIVE WEAR-ABILITY |
|---|---|---|---|---|---|---|
| | | 3317 West 11th St. Houston, TX 77248 | | formulation of ethylene propylene - with a hardness of 65 on the durometer scale | 11 9/16" ID × 30" long cylinder bonded into spool with red RTV-106 | |
| 6 | Elastomer | Grant Oil Tool Co. 3317 West 11th St. Houston, TX 77248 | unknown | EPDM - a proprietary formulation of ethylene propylene - with a hardness of 75 on the durometer scale | Formed into a 16 1/16" OD × 11 9/16" ID × 30" long cylinder with 5 internally molded stiffening rings. Bonded to spool by manufacturer | 5 |
| 7 | Oil Well Cement | Halliburton Services Company Duncan, OK 73536 | Tail Slurry | API Class "G" cement, 40% silica flour, 0.65% CFR-2 and metagreywacke well cuttings | Formed into a cylinder by casting in the vertical position using a piece of 10" plastic pipe for the inner mold. | 2 |
| 8 | Polymer Concrete | Unocal Corporation 1201 West 5th St. Los Angeles, CA 90051 | | Unocal proprietary formulation. Originally developed by Brookhaven National Laboratories | Material is spun cast in horizontal position, forming a uniform coating on the pipe I.D. | 4 |
| 9 | Silicon Carbide | Coors Porcelain Co. 600 9th St. Golden, CO 80401 | Coors Cerasurf TM SCNB-15 | 73% silicon carbide 25% bonding materials 3% oxides | Fired into a cylinder that we will retain in spool with mechanical rings and Bakerlock. | Untested |
| 10 | Plain Carbon Steel | | | | Spool is uncoated. Any wear is distributed throughout the circumference by rotation, works well under most drilling conditions. Unacceptable in Felsite formation | 8 |

*Relative Wearability - This scale takes into account wearability, cost, ease of repair, and ease of installation of the wear material and retaining (bonding) device.

TABLE 2

| EX. NO. | BONDING MATERIAL | MANUFACTURER | TRADENAME | MATERIAL CONTENT | RELATIVE BONDING WEARABILITY* |
|---|---|---|---|---|---|
| 11 | Grout | Pakco Industrial Ceramics | | Unknown | Poor |
| 12 | Silicon Rubber | General Electric Company Silicon Products Div. Waterford, NY 12188 | Red RTV-106 Silicon Rubber | Unknown | Poor |
| 13 | High Temperature Epoxie | Baker International Corp. San Antonio, TX | Bakerlock ® | Unknown | Good |

While particular embodiments of the invention have been described, it will be understood that the invention is not limited thereto since many obvious modification can be made. It is intended to include within this invention any such modification as will fall within the scope of the appended claims.

Having described the invention, we claim:

1. Apparatus for changing the direction of flow of a stream of particulate-laden, pressurized fluid, said apparatus comprising:

(a) a first fluid flow conduit having a fluid flow inlet at one end region thereof and a fluid discharge opening formed through a side wall thereof;

(b) a second fluid flow conduit connected to the outside of said first conduit at said sidewall opening to receive the flow of liquid discharged therethrough;

(c) a third fluid flow conduit, said third conduit having at at least one end region sized to slidingly fit into said second conduit and having an inner wear surface for deflecting the fluid flow from the first conduit through a substantial angle, the third flow conduit comprising a tubular member having first and second, axially spaced apart, annular sealing flanges extending radially outwardly therefrom;

(d) a fourth fluid flow conduit; and (e) first connecting means for releasably connecting said third conduit, in a fluid-tight relationship, to said second conduit with said one end slidingly fit thereinto and with a discharge end of the third conduit extending outwardly therefrom a substantial distance, and second connecting means for separately and releasably connecting the discharge end of the third conduit, in a fluid-tight relationship, to the fourth conduit, said first and second connecting means being configured for permitting said third conduit to be rotated relative to the second conduit so as to expose different regions of the wear surface to impingement of the fluid flow from the first conduit without removing the third conduit from either the second or the fourth conduits, said first connecting means comprising first clamping means for releasably clamping said third conduit first sealing flange to said second conduit and said second connecting means comprising second clamping means for releasably clamping said third conduit second sealing flange to said fourth conduit.

2. The apparatus as claimed in claim 1 wherein said first clamping means comprise a first, annular coupling flange slidingly disposed on said third conduit and said second clamping means comprise a second, annular coupling flange slidingly disposed on said third conduit, said first and second coupling flanges being confined on said third conduit between said first and second sealing flanges.

3. The apparatus as claimed in claim 2, wherein the first clamping means include an annular coupling flange fixed to said second conduit and wherein the second clamping means include an annular coupling flange fixed to the fourth coupling.

4. The apparatus as claimed in claim 1 wherein said third conduit has an inner lining on which said wear surface is formed.

5. The apparatus as claimed in claim 1 wherein the wear surface comprises weld beads built up on inner surface regions of the third conduit.

6. The apparatus as claimed in claim 1 wherein the third conduit is substantially longer than the second conduit.

7. Apparatus for changing the direction of flow of a stream of high pressure, particulate-laden fluid, said apparatus comprising:

(a) a first fluid flow conduit having a fluid flow inlet at one end region thereof and a fluid discharge opening formed through a side wall thereof;

(b) a second fluid flow conduit connected to the outside of said first conduit at said sidewall opening to receive the flow of liquid discharged therethrough;

(c) a third fluid flow conduit, said third conduit having at least one end region sized to slidingly fit into said second conduit and having an inner wear surface for deflecting the fluid flow from the first conduit through a substantial angle, the third conduit comprising a tubular member having fixed thereto first and second, axially spaced apart, annular sealing flanges extending radially outwardly therefrom;

(d) a fourth fluid flow conduit; and (e) first connecting means for releasably connecting said third conduit, in a fluid-tight relationship, to said second conduit with said one end slidingly fit thereinto and with a discharge end of the third conduit extending outwardly therefrom a substantial distance, and second connecting means for separately and releasably connecting the discharge end of the third conduit, in a fluid-tight relationship, to the fourth conduit, said first and second connecting means being configured for permitting said third conduit to be rotated relative to the second conduit so as to expose different regions of the wear surface to impingement of the fluid flow from the first conduit without removing the third conduit from either the second or the fourth conduits, said first connecting means including first clamping means for releasably clamping the first sealing flange of the third conduit to said second conduit and said second connecting means including second clamping means for releasably clamping the second sealing flange of the third conduit to said fourth conduit.

8. The apparatus as claimed in claim 7 wherein said first clamping means comprise a first, annular coupling flange slidingly disposed on said third conduit and said second clamping means comprise a second, annular coupling flange slidingly disposed on said third conduit, said first and second coupling flanges being confined on the third conduit between said first and second sealing flanges.

9. The apparatus as claimed in claim 8 wherein the first clamping means include an annular coupling flange fixed to said second conduit and wherein the second clamping means include an annular coupling flange fixed to the fourth conduit.

10. Apparatus for changing the direction of a high velocity flow of a particular-laden fluid which includes a drilling gas mixed with geothermal steam, said apparatus comprising:

(a) a first fluid flow conduit having a fluid flow inlet at one end region thereof for receiving said flow of particulate-laden fluid and an opening formed through a side wall thereof for the discharge of said flow of fluid therefrom;

(b) a second fluid flow conduit connected to the outside of said first conduit at said sidewall opening to receive the flow of fluid discharged therethrough;

(c) a third fluid flow conduit, said third conduit having at at least one end region sized to slidingly fit into said second conduit and having an inner wear surface for deflecting, through a substantial angle, the flow of fluid discharged from the first conduit; the third conduit comprising a tubular member having fixed thereto first and second, axially spaced apart, annular sealing flanges extending radially outwardly therefrom;

(d) a fourth fluid flow conduit for conducting said flow of fluid to an associated venting apparatus; and (e) first connecting means for releasably connecting said third conduit, in a fluid-tight relationship, to said second conduit with said one end slidingly fit thereinto and with a discharge end of the third conduit extending outwardly therefrom a substantial distance, and second connecting means for separately and releasably connecting the discharge end of the third conduit, in a fluid-tight relationship, to the fourth conduit, said first and second connecting means being configured for permitting said third conduit to be rotated relative to the second conduit so as to expose different regions of the wear surface to impingement of the fluid flow from the first conduit without removing the third conduit from either the second or the fourth conduits, said first connecting means including first clamping means for releasably clamping the first sealing flange of the third conduit to said second conduit and said second connecting means including second clamping means for releasably clamping the second sealing flange of the third conduit to said fourth conduit, said first clamping means comprising a first, annular coupling flange slidingly disposed on said third conduit and said second clamping means comprising a second, annular coupling flange slidingly disposed on said third conduit, said first and second coupling flanges being confined between said first and second sealing flanges.

11. The apparatus as claimed in claim 10 wherein the first clamping means include an annular coupling flange fixed to said second conduit and wherein the second clamping means include an annular coupling flange fixed to the fourth coupling.

12. The apparatus as claimed in claim 10 wherein said third conduit has an inner liner on which said wear surface is formed.

13. The apparatus as claimed in claim 10 wherein the wear surface comrises weld beads built up on inner surface regions of the third conduit.

14. The apparatus as claimed in claim 10 wherein the third conduit is substantially longer than the second conduit and wherein the second conduit includes an internal stop for limiting how far the third conduit can be inserted into the second conduit.

* * * * *

UNITED STATES PATENT AND TRADEMARK OFFICE

CERTIFICATE OF CORRECTION

PATENT NO. : 4,811,799

DATED : March 14, 1989

INVENTOR(S) : Wayne V. Blackwell and William P. Warren

It is certified that error appears in the above-identified patent and that said Letters Patent is hereby corrected as shown below:

In column 7, line 58, delete "at" (first occurrence).

In column 10, line 14, delete "at" (first occurrence).

In column 10, line 61, change "comrises" to --comprises--.

Signed and Sealed this

Seventh Day of November, 1989

*Attest:*

JEFFREY M. SAMUELS

*Attesting Officer*

*Acting Commissioner of Patents and Trademarks*